US009382661B2

(12) United States Patent
Nemoto et al.

(10) Patent No.: US 9,382,661 B2
(45) Date of Patent: Jul. 5, 2016

(54) INDUCTION HEATING UNIT AND FIXING DEVICE AND IMAGE FORMING APPARATUS INCLUDING THIS

(71) Applicant: KYOCERA Document Solutions Inc., Osaka (JP)

(72) Inventors: Shinji Nemoto, Osaka (JP); Masaru Takagi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/739,837

(22) Filed: Jun. 15, 2015

(65) Prior Publication Data

US 2015/0378291 A1 Dec. 31, 2015

(30) Foreign Application Priority Data

Jun. 27, 2014 (JP) ..... 2014-132038

(51) Int. Cl.

| | |
|---|---|
| ***G03G 15/20*** | (2006.01) |
| ***D21F 5/16*** | (2006.01) |
| ***H05B 6/14*** | (2006.01) |
| ***H05B 6/36*** | (2006.01) |

(52) U.S. Cl.

CPC ..... *D21F 5/165* (2013.01); *G03G 15/2053* (2013.01); *H05B 6/145* (2013.01); *H05B 6/365* (2013.01); *G03G 2215/0132* (2013.01); *G03G 2215/2032* (2013.01)

(58) Field of Classification Search

CPC ..... G03G 15/2057; H05B 6/109
USPC ..... 399/122, 328, 329, 330
See application file for complete search history.

(56) References Cited

U.S. PATENT DOCUMENTS

2014/0072352 A1* 3/2014 Naito et al. ..... 399/329

FOREIGN PATENT DOCUMENTS

JP 2009-109648 A 5/2009

* cited by examiner

*Primary Examiner* — Hoang Ngo
(74) *Attorney, Agent, or Firm* — Studebaker & Brackett PC

(57) ABSTRACT

A induction heating unit is configured to inductively heat a heating member being rotated in a predetermined rotating direction by magnetic flux. The induction heating unit includes a housing, a magnetic flux generating source, a core member and a securing member. The magnetic flux generating source is fixed to the housing so as to extend in a sheet width direction intersecting the rotating direction and is configured to generate the magnetic flux. The core member is made of magnetic material, is secured to the housing and is configured so as to make a magnetic path through which the magnetic flux passes. The securing member is made of thermal contraction material and is contracted by being heated at predetermined temperature to secure the core member to the housing.

13 Claims, 9 Drawing Sheets

INDUCTION HEATING UNIT AND FIXING DEVICE AND IMAGE FORMING APPARATUS INCLUDING THIS

INCORPORATION BY REFERENCE

This application is based on and claims the benefit of priority from Japanese Patent application No. 2014-132038 filed on Jun. 27, 2014, the entire contents of which are incorporated herein by reference.

BACKGROUND

The present disclosure relates to an induction heating unit, and a fixing device and an image forming apparatus including this.

An image forming apparatus, such as a copying machine, facsimile and printer, includes an image forming part forming an image on an image carrier (e.g. a photosensitive drum), a transferring part transferring a toner image on the image carrier onto a sheet as one example of a recording medium and a fixing device heating the toner image transferred on the sheet and fixing it onto the sheet.

As the fixing device, that including an electromagnetic induction heating (IH) unit making rapid heating and high efficient heating possible is known. In such an electromagnetic induction heating manner, induced current is induced to a fixing roller or a fixing belt by magnetic flux generated by flowing high frequency current to an induction coil, and then, Joule heat (induction heat) is generated in the fixing roller or the fixing belt. By the Joule heat, the toner image is fixed onto the sheet (the recording medium).

For example, in the fixing device including the electromagnetic induction heating unit, a technique holding an arch core making a magnetic path by a given holder is proposed. Between the arch core and the holder, an elastic member is arranged. When a shield in a lid shape is attached to the holder, the arch core is positioned by elastic force of the elastic member.

In the above-mentioned fixing device, there are problems that, when the shield is attached to the holder, a position of the elastic member is shifted and the position of the arch core is not accurately determined.

SUMMARY

In accordance with an embodiment of the present disclosure, a induction heating unit is configured to inductively heat a heating member being rotated in a predetermined rotating direction by magnetic flux. The induction heating unit includes a housing, a magnetic flux generating source, a core member and a securing member. The magnetic flux generating source is fixed to the housing so as to extend in a sheet width direction intersecting the rotating direction and is configured to generate the magnetic flux. The core member is made of magnetic material, is secured to the housing and is configured so as to make a magnetic path through which the magnetic flux passes. The securing member is made of thermal contraction material and is contracted by being heated at predetermined temperature to secure the core member to the housing.

In accordance with an embodiment of the present disclosure, a fixing device includes the above-mentioned induction heating unit and the heating member being rotated in a predetermined rotating direction, inductively heated by the magnetic flux and configured so as to perform fixing process to a sheet.

In accordance with an embodiment of the present disclosure, an image forming apparatus includes an image carrier having a surface onto which a toner image is formed, a transferring part transferring the toner image onto the sheet and the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
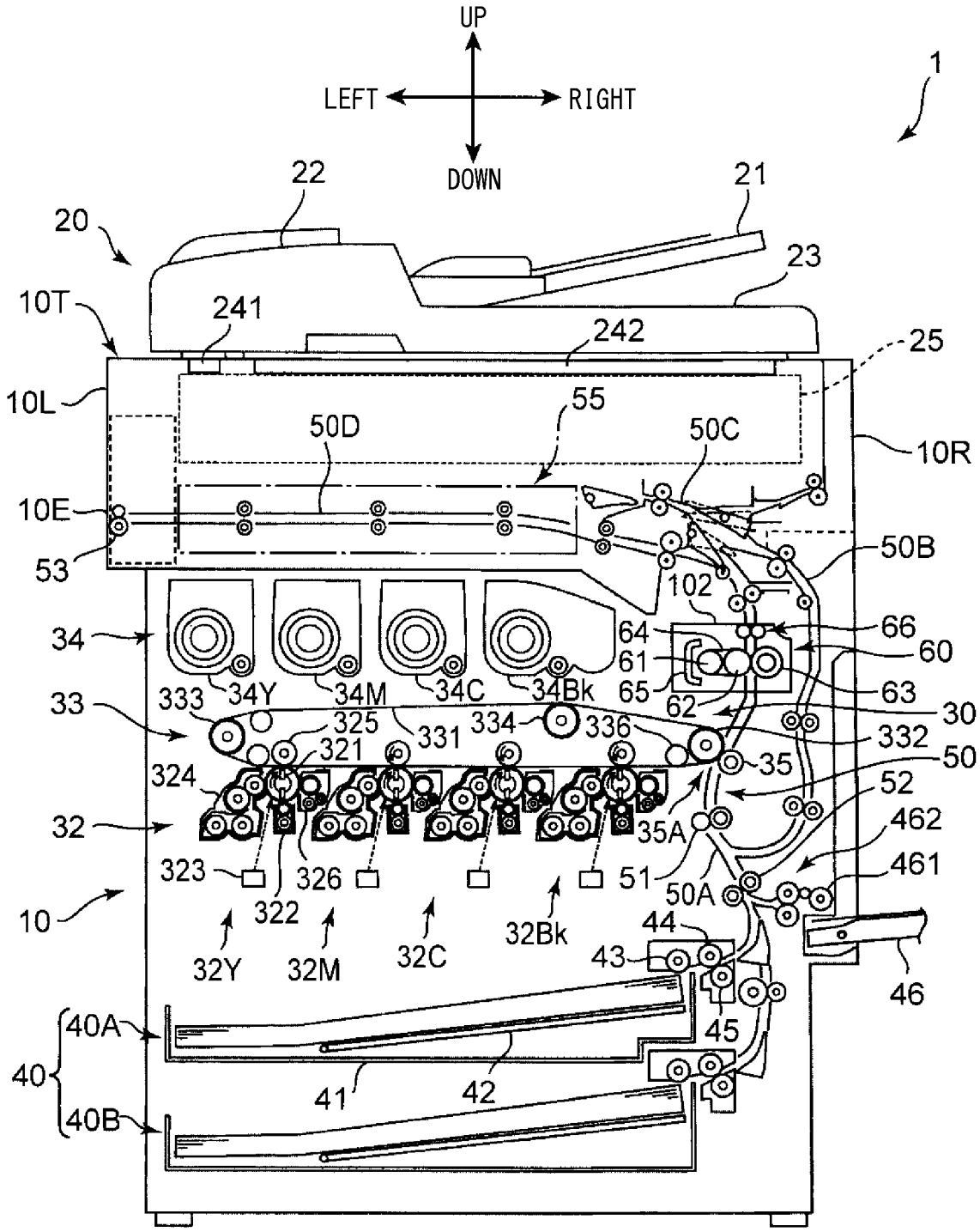
FIG. 1 is a sectional view showing an internal configuration of an image forming apparatus according to an embodiment of the present disclosure.

In the following, an embodiment of the present disclosure will be described in detail with reference to the drawings. FIG. 1 is a sectional view showing an internal configuration of an image forming apparatus 1 according to the embodiment of the present disclosure. Here, as the image forming apparatus 1, a copying machine is illustrated, but the image forming apparatus 1 may be a printer, a facsimile or a multifunction machine having their functions as long as an induction heating (IH) manner is applied.

The image forming apparatus 1 includes an apparatus main body 10 having a roughly rectangular-parallelepiped formed housing structure and an automatic document feeding device 20 located above the apparatus main body 10. Inside the apparatus main body 10, a reading unit 25, an image forming part 30, a fixing device 60, a sheet feeding part 40, a conveying path 50 and a conveying unit 55 are installed. The reading unit 25 optically reads a document image to be copied. The image forming part 30 forms a toner image onto a sheet. The fixing device 60 fixes the toner image onto the sheet. The sheet feeding part 40 stores the sheet conveyed to the image forming part 30. In the conveying path 50, the sheet is conveyed from the sheet feeding part 40 via the image forming part 30 and fixing device 60 to a sheet ejecting port 10E. Inside the conveying unit 55, a sheet conveying path composing of a part of the conveying path 50 is arranged.

The automatic document feeding device 20 is turnably attached to a top face of the apparatus main body 10. The automatic document feeding device 20 automatically feeds a document sheet to be copied toward a predetermined document reading position (a position at which a first contact glass 241 is fitted) in the apparatus main body 10. On the other hand, when a user manually places the document sheet on another predetermined document reading position (another position at which a second contact glass 242 is fitted), the automatic document feeding device 20 is opened upwardly. The automatic document feeding device 20 includes a document tray 21 on which the document sheet is placed, a document conveying part 22 conveying the document sheet via a document automatic-reading position and an ejected document tray 23 onto which the document sheet after reading is ejected.

The reading unit 25 optically reads an image of the document sheet via the first contact glass 241 for reading the document sheet automatically fed from the automatic document feeding device 20 on the top face of the apparatus main body 10, or via the second contact glass 242 for reading the document sheet manually placed. In the reading unit 25, a light source, a movement carriage, a scanning mechanism having a reflective mirror and others, and an imaging device are installed (not shown). The scanning mechanism irradiates the document sheet with a light and leads a reflected light from the document sheet to the imaging device. The imaging device photoelectrically converts the reflected light to an analog electrical signal. The analog electrical signal is converted to a digital electrical signal by an analog/digital (A/D) converting circuit, and then, inputted to the image forming part 30.

The image forming part 30 carries out processes forming a full color toner image and transferring this toner image onto the sheet. The image forming part 30 includes an image forming unit 32, an intermediate transferring unit 33 (a transferring part) located adjacent to and above the image forming unit 32, and a toner replenishing part 34 located above the intermediate transferring unit 33. The image forming unit 32 includes four units 32Y, 32M, 32C and 32Bk arranged in tandem that respectively form a yellow (Y) toner image, a magenta (M) toner image, a cyan (C) toner image and a black (Bk) toner image.

Each of the image forming unit 32Y, 32M, 32C and 32Bk includes a photosensitive drum 321 (an image carrier), and a charger 322, an exposure device 323, a development device 324, a first transferring roller 325 and a cleaning device 326 located around the photosensitive drum 321.

The photosensitive drum 321 rotates around its axis so that an electrostatic latent image and the toner image are formed onto its circumference face. The charger 322 uniformly electric-charges a surface of the photosensitive drum 321. The exposure device 323 includes a laser light source and optical instruments, such as a mirror and lens. The exposure device 323 irradiates the circumference face of the photosensitive drum 321 with a light based on image data of the document image to form the electrostatic latent image.

The development device 324 supplies a toner (a developer) to the circumference face of the photosensitive drum 321 in order to develop the electrostatic latent image formed onto the photosensitive drum 321. The first transferring roller 325 together with the photosensitive drum 321 sandwiches an intermediate transferring belt 331 provided in the intermediate transferring unit 33 to form a nip part and first-transfers the toner image on the photosensitive drum 321 onto the intermediate transferring belt 331. The cleaning device 326 includes a cleaning roller and others. The cleaning device 326 cleans the circumference face of the photosensitive drum 321 after the toner image is transferred.

The intermediate transferring unit 33 includes the intermediate transferring belt 331, a driving roller 332, a following roller 333, a tension roller 334 and a backup roller 336. The intermediate transferring belt 331 is an endless belt wound around these rollers 332, 333, 334, 336 and the first transferring roller 325. To an outer circumference face of the intermediate transferring belt 331, the toner images from a plurality of the photosensitive drums 321 are transferred so as to be superimposed at same one place (a first transfer).

Facing to a circumference face of the driving roller 332, a second transferring roller 35 is located. The second transferring roller 35 is an electric conductive roller. A nip part between the driving roller 332 and second transferring roller 35 works as a second transferring part 35A transferring the full color toner image superimposed onto the intermediate transferring belt 331 to the sheet. To the second transferring roller 35, second transfer bias potential having a reversed bias to the toner image is applied. The driving roller 332 is grounded.

The toner replenishing part 34 includes a yellow toner container 34Y, a magenta toner container 34M, a cyan toner container 34C and a black toner container 34Bk. These toner containers 34Y, 34M, 34C and 34Bk contain respective corresponding color toners and respectively supply the corresponding color toners to the development devices 324 of the image forming unit 32Y, 32M, 32C and 32Bk corresponding to the respective colors of Y, M, C and Bk via supplying paths (not shown).

The sheet feeding part 40 includes two stages of fed sheet cartridges 40A, 40B and a fed sheet tray 46 for manual bypass sheet feeding storing the sheets to be subjected an image forming process. These fed sheet cartridges 40A, 40B are configured so as to be pulled out from a front side of the apparatus main body 10 in a forward direction. These fed sheet cartridges 40A, 40B are cartridges provided for automatic sheet feeding, but the fed sheet tray 46 for manual bypass sheet feeding is openably/closably attached to the apparatus main body 10 at its lower end part. In a case of carrying out the manual bypass sheet feeding, the user opens the fed sheet tray 46 as shown in the figure and places the sheet thereon.

The fed sheet cartridge 40A (40B) includes a sheet storing part 41 storing a sheet stack having a plurality of piled sheets and a lift board 42 lifting up the sheet stack in order to feed the sheet. In an upper part of a right end side of the fed sheet cartridge 40A (40B), a pickup roller 43, and a roller pair of a sheet feeding roller 44 and a retard roller 45 are located. The pickup roller 43 and sheet feeding roller 44 are driven to pick up the sheet from the top layer of the sheet stack in the fed sheet cartridge 40A (40B) one by one and to convey the picked-up sheet to an upstream end of the conveying path 50. On the other hand, the sheet placed on the fed sheet tray 46 is conveyed to the conveying path 50 by driving a pickup roller 461 and a sheet feeding roller 462 similarly.

The conveying path 50 includes a main conveying path 50A, an inversion conveying path 50B, a switchback conveying path 50C and a horizontal conveying path 50D. The main conveying path 50A conveys the sheet from the sheet feeding part 40 via the image forming part 30 to an exit port of the fixing device 60. The inversion conveying path 50B returns back a simplex printed sheet to the image forming part 30 when a duplex printing is performed to the sheet. The switchback conveying path 50C directs the sheet from a downstream end of the main conveying path 50A to an upstream end of the inversion conveying path 50B. The horizontal conveying path 50D conveys the sheet from the downstream end of the main conveying path 50A to the sheet ejecting port 10E provided in a left lateral face 10L of the apparatus main body 10 in a horizontal direction. The most part of the horizontal conveying path 50D is made by a sheet conveying path provided in the conveying unit 55.

At an upstream side from the second transferring part 35A in the main conveying path 50A, a pair of paper stop rollers 51 are located. The sheet conveyed in the main conveying path 50A runs into the pair of paper stop rollers 51 in a stop state and is temporarily stopped, and then, skew correction is carried out. After that, at a given timing for transferring the image, the pair of paper stop rollers 51 is driven and rotated by a drive motor (not shown) to convey the sheet to the second transferring part 35A. Besides this, in the main conveying path 50A, a plurality of pairs of conveying rollers 52 for conveying the sheet are located. Other conveying path 50B, 50C and 50D are configured similarly.

At a most downstream end of the conveying path 50, a pair of sheet ejecting rollers 53 are located adjacent to the conveying unit 55 at a left side in FIG. 1. The pair of sheet ejecting rollers 53 feed the sheet via the sheet ejecting port 10E to a post-process device (not shown) arranged so as to be connected to the apparatus main body 10. Incidentally, in the image forming apparatus without attaching the post-process device, an ejected sheet tray is provided below the sheet ejecting port 10E.

The conveying unit 55 is a unit conveying the sheet conveyed from the fixing device 60 to the sheet ejecting port 10E. The conveying unit 55 conveys the sheet from a right lateral face 10R to a left lateral face 10L in the apparatus main body 10 in the horizontal direction.

Figure 2:
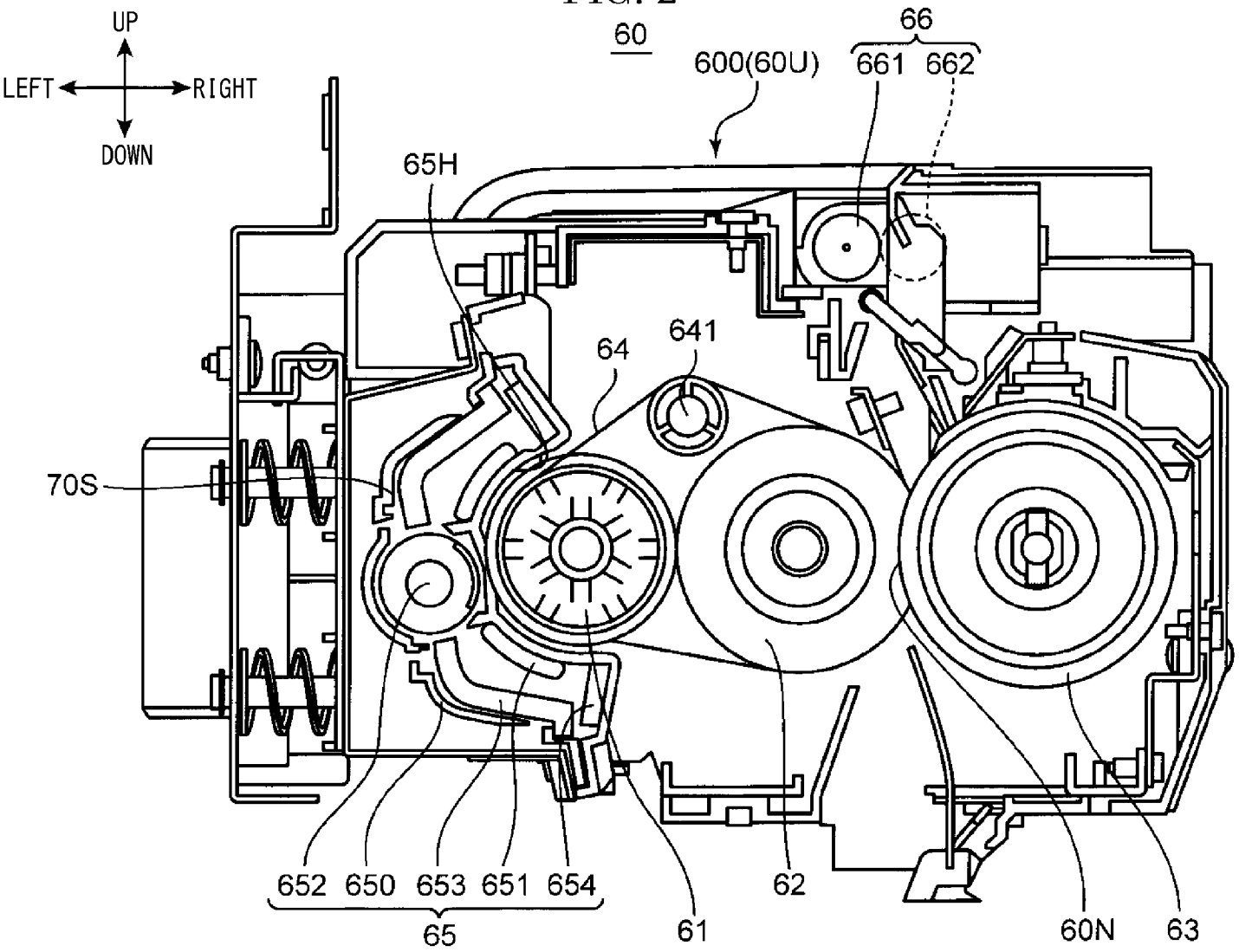
FIG. 2 is a sectional view showing an internal configuration of a fixing device according to the embodiment of the present disclosure.
Figure 3:
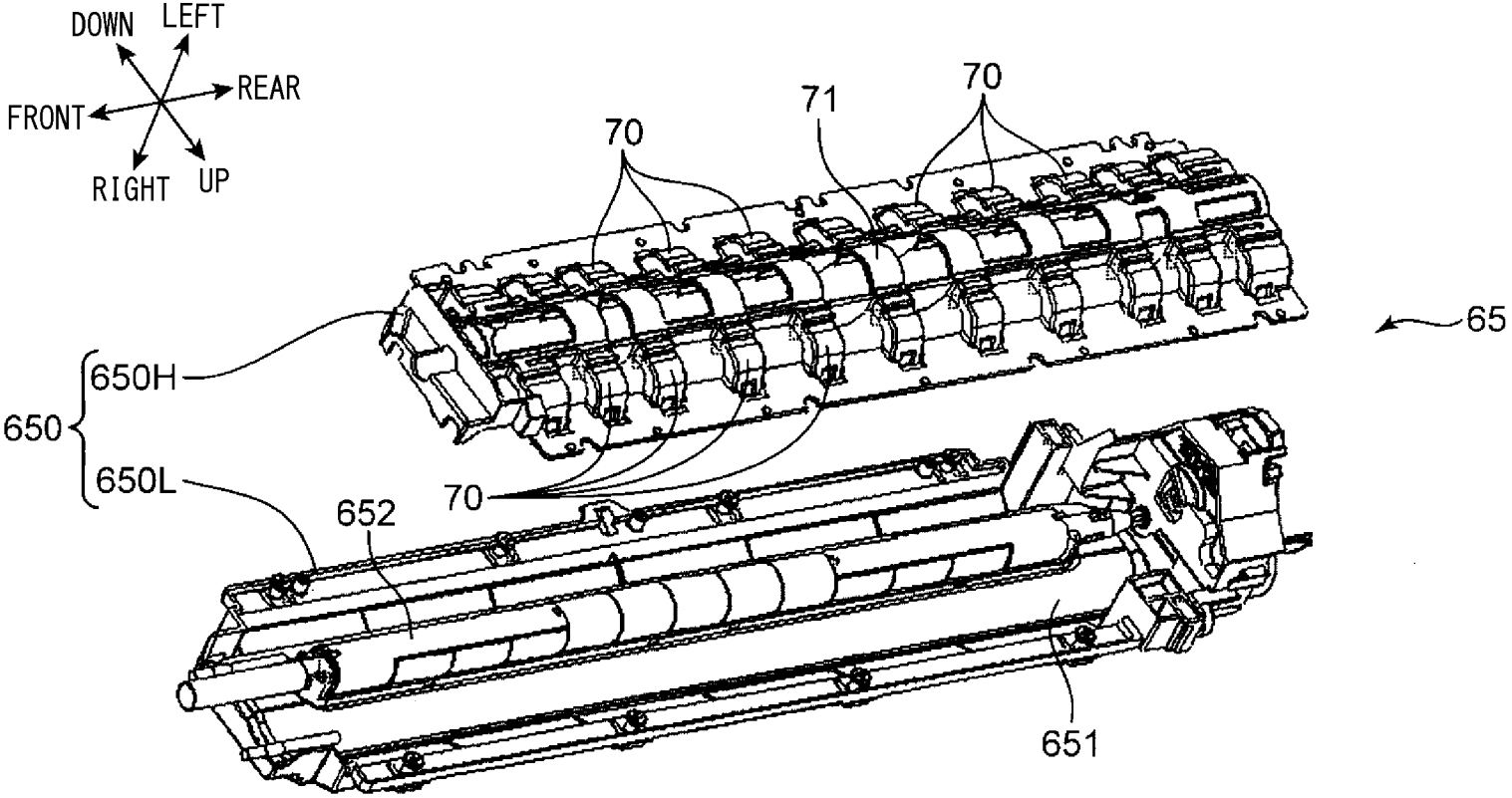
FIG. 3 is an exploded perspective view showing an induction heating unit according to the embodiment of the present disclosure.

The fixing device 60 is a fixing device of an induction heating manner carrying out fixing process fixing the toner image onto the sheet. FIG. 2 is a sectional view showing an internal configuration of the fixing device 60 and FIG. 3 is an exploded perspective view showing an induction heating unit 65.

The fixing device 60 includes a heating roller 61, a fixing roller 62, a pressuring roller 63, a fixing belt 64 (a heating member), the induction heating unit 65 and a pair of conveying rollers 66. The fixing device 60 is installed as a fixing unit 60U to the apparatus main body 10. The fixing unit 60U includes a fixing housing 600. The fixing housing 600 has a sectional shape in a roughly rectangular shape and houses each component carrying out the fixing process.

The heating roller 61 is a roller inductively heated by the induction heating unit 65. The heating roller 61 is made of, for example, magnetic metal, such as iron or stainless steel. In a surface of the heating roller 61, a release layer made of, for example, perfluoro alkoxy alkane (PFA), is formed. The heating roller 61 is rotated around its axis in a counterclockwise direction in FIG. 2.

The fixing roller 62 and the pressuring roller 63 are rollers to have respective circumference faces coming into pressure contact with each other across the fixing belt 64 and to form a fixing nip part 60N. The sheet with the toner image second-transferred in the second transferring part 35A passes through the fixing nip part 60N to be heated and pressured, thereby the toner image is fixed onto a sheet surface.

The fixing roller 62 is an elastic roller having an elastic layer in its surface layer. As the elastic layer, an elastic layer made of silicone sponge may be applied. The fixing roller 62 is rotated around its axis in the counterclockwise direction in FIG. 2.

The pressuring roller 63 is a roller pressuring the fixing roller 62 and forming the fixing nip part 60N in a predetermined width with the fixing belt 64. One preferable structure of the pressuring roller 63 is a structure including a metal core element, such as iron or aluminum, a silicone rubber layer formed on the core element and a fluororesin layer formed on a surface of the silicone rubber layer. The pressuring roller 63 has a surface layer with hardness higher than a surface of the fixing roller 62 and includes a heating element, such as a halogen heater, inside. The pressuring roller 63 is rotated around its axis in a clockwise direction in FIG. 2.

The fixing belt 64 is bridged between the heating roller 61 and the fixing roller 62, rotated and inductively heated by the induction heating unit 65 similarly to the heating roller 61. The fixing belt 64 is arranged so as to face to the induction heating unit 65. With an inner circumference face of the fixing belt 64, a tension roller 641 applying tension to the fixing belt 64 comes into contact. The fixing belt 64 is configured by forming a silicone rubber elastic layer and a PFA release layer in order on a base element made of, for example, ferromagnetic material, such as nickel. Incidentally, in a case where the fixing belt 64 is used simply as a carrier for heat generated by the heating roller 61 without providing heated function, a resin belt, such as polyimide (PI), may be used.

The induction heating unit 65 is a unit generating desired heat for fixing process to inductively heat the heating roller 61 and the fixing belt 64 by magnetic flux. The induction heating unit 65 includes an induction heating coil 651 (a magnetic flux generating source), a center core 652, a core composed of a plurality of pairs of arch cores 653 (core members) and a pair of side cores 654, and unit housing 650 housing these. The induction heating unit 65 is housed at a left end part of the fixing housing 600. The induction heating unit 65 is arranged so as to face to the fixing belt 64 in the horizontal direction.

Figures 3, 4:
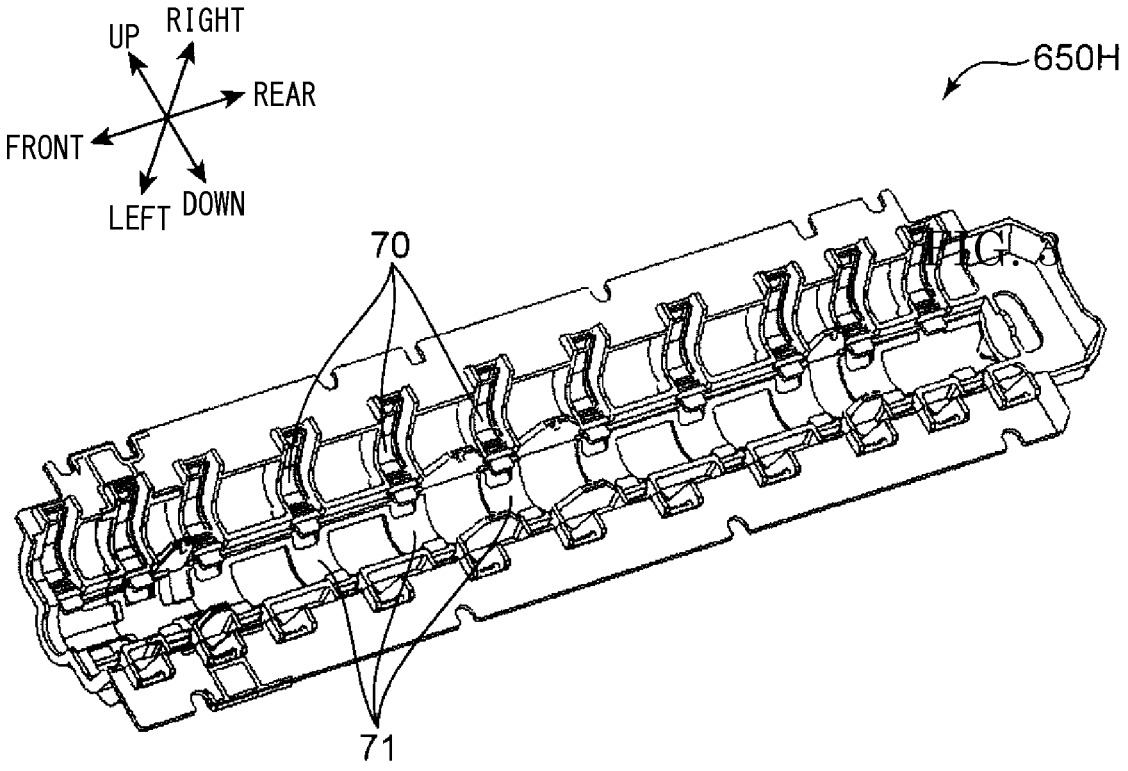
FIG. 4 is a perspective view showing partly a housing of the induction heating unit according to the embodiment of the present disclosure.

The induction heating unit 65 includes the unit housing 650 (a housing) (refer to FIG. 3). The unit housing 650 supports each member of the induction heating unit 65. The unit housing 650 includes a housing main body 650L and arch core holding unit 650H. FIG. 4 is a perspective view showing the arch core holding unit 650H. The housing main body 650L corresponds to a lower part of the unit housing 650. The arch core holding unit 650H is attached to an upper face part of the housing main body 650L.

The induction heating coil 651 is configured so as to generate the magnetic flux inductively heating the heating roller 61 and the fixing belt 64. The induction heating coil 651 is arranged on a virtual arch face facing to arch faces of the heating roller 61 and the fixing belt 64 as viewed in a cross section in the housing main body 650L of the unit housing 650 (refer to FIG. 2). The induction heating coil 651 is a winding wire wound in a roughly elliptic shape so as to surround the center core 652 as viewed from a left lateral face side. The induction heating coil 651 is fixed to the housing main body 650L so as to extend in a sheet width direction (forward and backward directions, an axis direction of the heating roller 61) intersecting a rotating direction of the heating roller 61.

The center core 652, the plurality of pairs of arch cores 653 and the pair of side cores 654 are core members made of ferrite (magnetic material) and are arranged in order to make a magnetic path passing through partly the heating roller 61 and the fixing belt 64. The center core 652 is arranged so as to be surrounded by the induction heating coil 651 and to extend in the forward and backward directions. Each pair of arch cores 653 are arranged so as to cover the induction heating coil 651 from a left side and to sandwich the center core 652 in upward and downward directions. Incidentally, each arch core 653 does not have a shape extending continuously in the forward and backward directions, but a plurality of members formed in an arch shape as shown in FIG. 2 are arranged in the forward and backward directions at intervals. Therefore, the induction heating coil 651 is partly exposed at the left side between adjacent arch cores 653. When the magnetic flux generated by the induction heating coil 651 passes through the magnetic path, eddy current is generated in the heating roller 61 and the fixing belt 64 and Joule heat according to this is generated.

The housing main body 650L of the unit housing 650 is a housing member holding the above-mentioned induction heating coil 651 and the side core 654 and includes an arc-formed recessed part 65H in which the heating roller 61 and the fixing belt 64 are partly inserted (refer to FIG. 2). The unit housing 650 of the induction heating unit 65 and the fixing housing 600 of the fixing unit 60U are fitted to each other in a positioned state and, between an inner circumference face of the recessed part 65H and a surface of the fixing belt 64, a gap is arranged at a predetermined interval.

With reference to FIG. 2, the pair of conveying rollers 66 are a pair of conveying rollers sending the sheet passed through the fixing nip part 60N to the horizontal conveying path 50D (refer to FIG. 1) at a downstream side of the fixing housing 600. The pair of conveying rollers 66 are composed of a first conveying roller 661 and a second conveying roller 662 supported rotatably in the fixing housing 600. The first conveying roller 661 is a driving roller rotating by rotation driving force inputted from a side of the apparatus main body 10 and the second conveying roller 662 is a following roller co-rotating according to rotation of the first conveying roller 661. The second conveying roller 662 comes into pressure contact with the first conveying roller 661 by a predetermined nip pressure in order to provide sheet conveying capacity.

With reference to FIG. 3, the arch core holding unit 650H includes arch core holding parts 70 (a part of the housing) and center core facing parts 71. The arch core holding parts 70 are a plurality of holding members arranged at intervals in the sheet width direction in the arch core holding unit 650H. A plurality of the arch core holding parts 70 being adjacent to each other in the forward and backward directions are arranged so as to face to each other as a pair in the upward and downward directions. To the respective arch core holding parts 70, the arch cores 653 are secured. Each center core facing part 71 is arranged between the facing arch core holding parts 70. The center core facing parts 71 are arranged so as to cover partly the center core 652 from the left side. A plurality of the center core facing parts 71 are arranged at intervals in the forward and backward directions similarly to the arch core holding parts 70.

Figure 5:
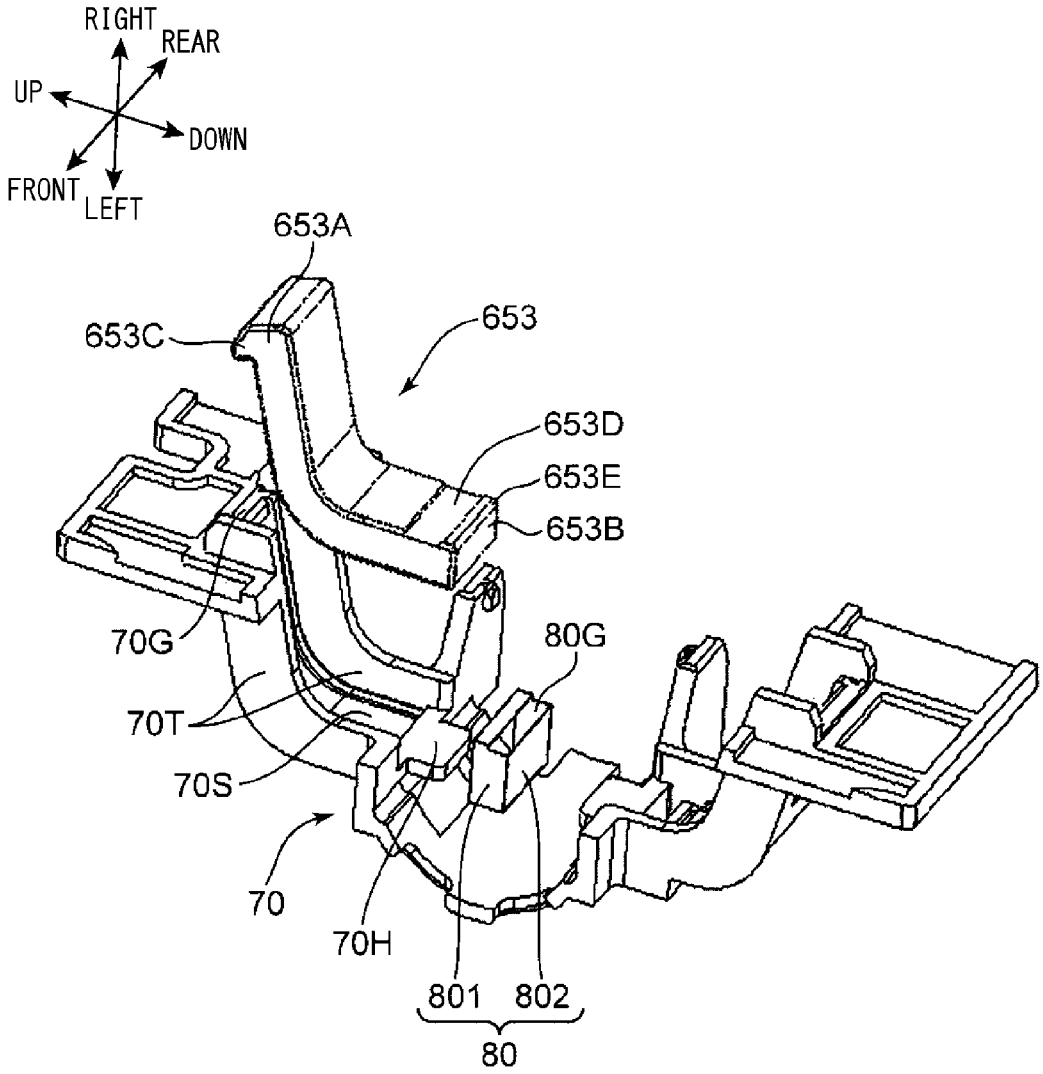
FIG. 5 is an exploded perspective view showing a core member, the housing and a securing member according to a first embodiment of the present disclosure.
Figure 6A:
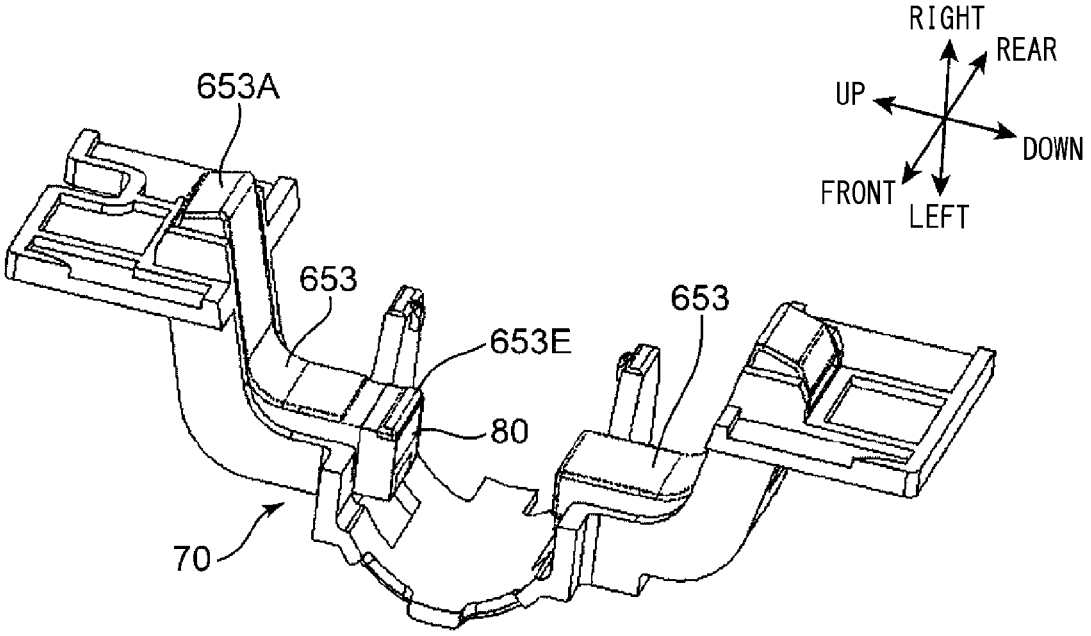
FIG. 6A is a perspective view showing the core member, the housing and the securing member in a condition where the core member is secured to the housing
Figure 6B:
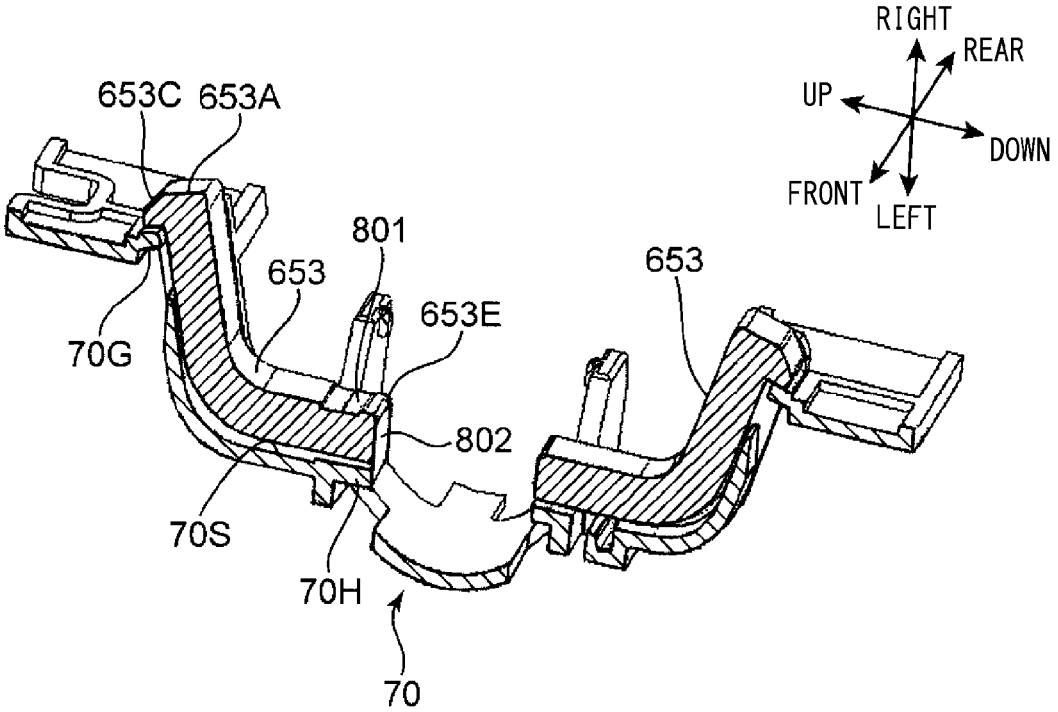
FIG. 6B is a sectional perspective view showing the core member, the housing and the securing member in a condition where the core member is secured to the housing, in accordance with the first embodiment of the present disclosure.

Next, a securing situation of each arch core 653 to the arch core holding unit 650H according to a first embodiment of the present disclosure will be described. FIG. 4 is a perspective view of the arch core holding unit 650H. FIG. 5 is an exploded perspective view of the arch core 653, the arch core holding part 70 of the arch core holding unit 650H and a thermal contraction cap 80 according to the embodiment. FIGS. 6A and 6B are a perspective view and a sectional perspective view showing a situation where the arch core 653 is secured to the arch core holding part 70. FIG. 5 shows a situation where the arch core 653 in FIG. 6A is moved to a right side indicated by an arrow in the figure and the thermal contraction cap 80 is moved to a lower side similarly.

With reference to FIG. 2, the arch core 653 is formed in a rectangular shape as viewed in a cross section intersecting a rotating direction of the fixing belt 64 and is a member extending in an arch shape along the rotating direction of the fixing belt 64. With reference to FIG. 5, the arch core 653 includes a first core end part 653A (one end part), a second core end part 653B (another end part), an engaging part 653C, a gap part 653D (a first gap part) and a protruding part 653E. The first core end part 653A is one end part of the arch core 653 formed in an arch shape and the second core end part 653B is another end part of the arch core 653. Incidentally, with reference to FIGS. 2 and 5, the first core end part 653A is arranged at an upstream side in the rotating direction of the fixing belt 64 in the arch core 653 and the second core end part 653B is arranged at a downstream side in the rotating direction of the fixing belt 64 in the arch core 653.

The engaging part 653C is a projected piece formed in a distal end part of the first core end part 653A. The engaging part 653C is formed in a shape projected from a distal end of the first core end part 653A toward a direction intersecting the rotating direction of the fixing belt 64.

The gap part 653D is a gap formed in one face of the second core end part 653B. The gap part 653D is formed along a face of the second core end part 653B facing to the induction heating coil 651 (refer to FIG. 2) in the forward and backward directions. Incidentally, into the gap part 653D, a part of a cap lateral part 801 of the thermal contraction cap 80 as mentioned later is fitted. The protruding part 653E is a part formed by a part of the second core end part 653B protruded at a distal end side from the gap part 653D by forming the gap part 653D in the second core end part 653B. The protruding part 653E is inserted into an opening part 80G of the thermal contraction cap 80 as mentioned later.

Incidentally, other arch core 653 facing to the arch core 653 in FIG. 5 in the upward and downward directions has a similar form. However, in the other arch core 653, the first core end part 653A is arranged at the downstream side in the rotating direction of the fixing belt 64 in the arch core 653 and the second core end part 653B is arranged at the upstream side in the rotating direction of the fixing belt 64 in the arch core 653.

With reference to FIG. 5, each arch core holding part 70 includes an installation face 70S, a pair of lateral walls 70T, an engaged part 70G and a holding piece 70H (a projected piece). The installation face 70S is a face facing to the arch core 653 and is formed in an arch shape similar to the arch core 653. The pair of lateral walls 70T are lateral walls erected at front and rear side edges of the installation face 70S. By the installation face 70S and the pair of lateral walls 70T, a housing part housing the arch core 653 is formed.

The engaged part 70G (refer to FIGS. 5 and 6B) is a wall face connected to one end side of the installation face 70S. With the engaged part 70G, the engaging part 653C of the arch core 653 is engaged. As a result, the first core end part 653A of the arch core 653 is secured.

The holding piece 70H is a projected piece connected to an opposite side to the engaged part 70G in the installation face 70S, i.e. another end side of the installation face 70S. The holding piece 70H is projected downwardly along the second core end part 653B of the arch core 653. Incidentally, other arch core holding part facing to the arch core holding part 70 in FIG. 5 in the upward and downward directions has a similar form.

The thermal contraction cap 80 is installed to the second core end part 653B of the arch core 653. The thermal contraction cap 80 is made of thermal contraction material and has a function contracting by being initially heated at predetermined temperature and securing the arch core 653 to the arch core holding part 70. The thermal contraction cap 80 is a roughly rectangular-parallelepiped formed cap in which its inside space is opened by opening one face. In other words, the thermal contraction cap 80 includes the cap lateral part 801 (a part having a first ring shape) and a cap facing part 802 (a sealing face). The thermal contraction cap 80 includes the opening part 80G.

The cap lateral part 801 has a shape bundling integrally the second core end part 653B of the arch core 653 and the holding piece 70H. In other words, the cap lateral part 801 is composed of four lateral faces forming a rectangular shape by connecting to each other in the thermal contraction cap 80 formed in a roughly rectangular-parallelepiped shape. The cap facing part 802 is a sealing face connected to the cap lateral part 801 composed of four lateral faces in the thermal contraction cap 80. The cap facing part 802 is arranged so as to face to the second core end part 653B of the arch core 653 and the distal end part of the holding piece 70H.

The opening part 80G is an opening part formed in a right lateral face of the thermal contraction cap 80. Into the opening part 80G, the protruding part 653E of the arch core 653 is inserted.

With reference to FIGS. 5, 6A and 6B, when the arch core 653 is secured to the arch core holding part 70, an assembling worker engages the engaging part 653C of the first core end part 653A with the engaged part 70G. Subsequently, the arch core 653 is located between the pair of lateral walls 70T so that the second core end part 653B is along the holding piece 70H. Further, the assembling worker installs the thermal contraction cap 80 to the second core end part 653B and the holding piece 70H so that the protruding part 653E is inserted into the opening part 80G of the thermal contraction cap 80. At this time, one face of the cap lateral part 810 of the thermal contraction cap 80 is engaged with the gap part 653D.

As shown in FIG. 4, to a plurality of arch core holding parts 70 directed in line symmetry in the upward and downward directions and arranged in the forward and backward directions, the plurality of arch cores 653 and the thermal contraction caps 80 are installed, respectively. The assembling worker heats the adjacent thermal contraction caps 80 in order by using a given heating tool. As a result, the thermal contraction cap 80 is thermally contracted, and accordingly, the holding piece 70H and the second core end part 653B are strongly secured in a body. Subsequently, the engaging part 653C of the arch core 653 is engaged with the engaged part 70G and the second core end part 653B is secured to the holding piece 70H, and accordingly, the arch core 653 is stably secured to the arch core holding part 70. In this time, since the engaging part 653C of the arch core 653 acts as a fulcrum, the arch core 653 is stably secured to the arch core holding part 70 by one thermal contraction cap 80. Incidentally, when the thermal contraction cap 80 is heated, binding force bundling the second core end part 653B and the holding piece 70H by the cap lateral part 801 of the thermal contraction cap 80 is applied. Further, while the cap facing part 802 of the thermal contraction cap 80 is contracted, and simultaneously, comes into close contact with the second core end part 653B and the distal end part of the holding piece 70H, and accordingly, the arch core 653 is strongly secured to the arch core holding part 70.

Thus, in the embodiment, in assembling process of the induction heating unit 65, by heating and contracting the thermal contraction cap 80, the arch core 653 can be secured to the arch core holding unit 650H for a short time. Therefore, it is possible to improve assembling efficiency of the induction heating unit 65. Particularly, in the embodiment, as shown in FIG. 4, the thermal contraction cap 80 is installed at a side of the second core end part 653B (refer to FIG. 5) of the arch core holding part 70 adjacent to the center core facing part 71. Moreover, in the first core end part 653A at an opposite side to the second core end part 653B, the engaging part 653C is engaged with the engaged part 70G. Therefore, the worker can prepare the heating tool near the center core facing part 71 and heat the respective thermal contraction caps 80 while moving the heating tool along the forward and backward directions. As a result, it is possible to carry out work heating the plurality of thermal contraction caps 80 in the arch core holding unit 650H for a short time.

Further, in the embodiment, the protruding part 653E of the arch core 653 is inserted into the opening 80G and the cap lateral part 801 of the thermal contraction cap 80 is engaged with the gap part 653D (refer to FIG. 5). As a result, it is possible to prevent the thermal contraction cap 80 from being detached from the arch core 653.

Moreover, since the thermal contraction cap 80 is made of the thermal contraction material, even if temperature of the induction heating unit 65 is risen according to induction heating of the fixing belt 64, the thermal contraction cap 80 is deformed so as to contract, and therefore, securing structure of the arch core 653 is not loosen at all. Therefore, as compared with other securing situations using adhesive or the like, it is possible to restrain a position of the arch core 653 from varying.

Incidentally, if the cap lateral part 801 formed in a roughly ring shape is contracted to the inside in a radial direction, the arch core 653 is biased toward the installation face 70S. The installation face 70S is a face facing to the fixing belt 64 (refer to FIG. 2) of the induction heating unit 65. According to this, it is possible to stably maintain the position of the arch core 653 with respect to the fixing belt 64. Therefore, since the magnetic path can be stably made by the arch core 653, it is possible to stably maintain temperature of the fixing belt 64 in heating.

Figure 7A:
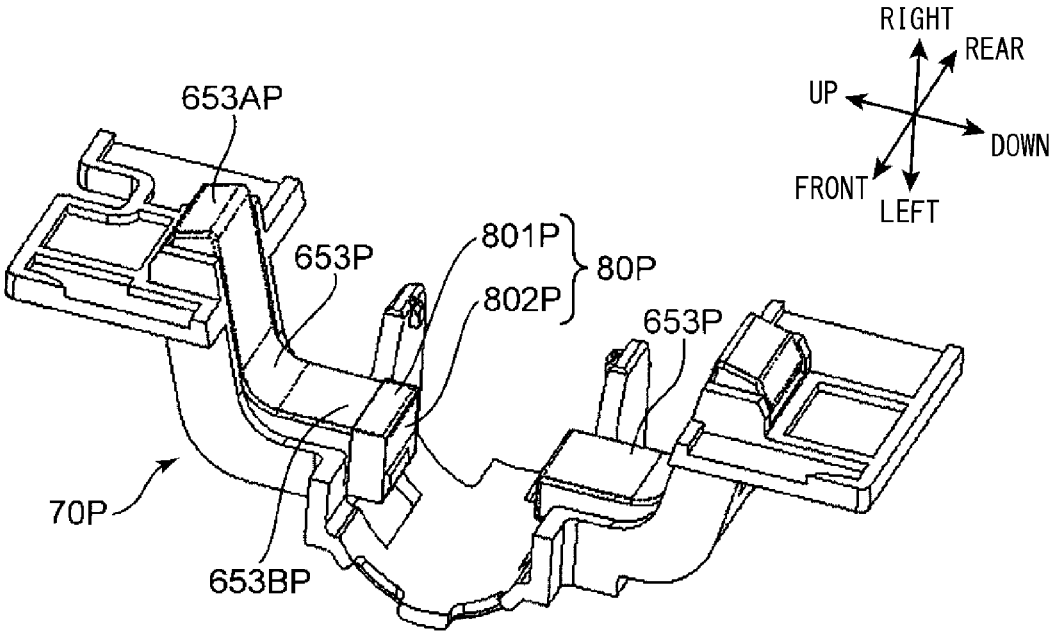
FIG. 7A is a perspective view showing the core member, the housing and the securing member in a condition where the core member is secured to the housing
Figure 7B:
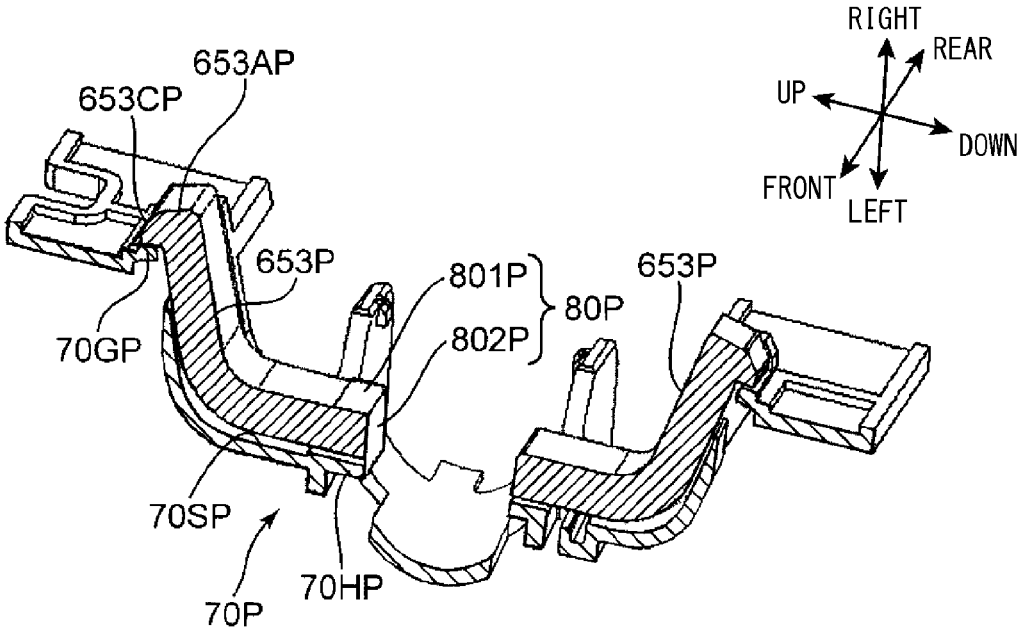
FIG. 7B is a sectional perspective view showing the core member, the housing and the securing member in a condition where the core member is secured to the housing, in accordance with a second embodiment of the present disclosure.

Next, a securing structure of an arch core 653P (a core member) according to a second embodiment of the present disclosure will be described. FIGS. 7A and 7B are a perspective view and a sectional perspective view showing a situation where the arch core 653P according to the second embodiment is secured to an arch core holding part 70P (a part of the housing). In the second embodiment, as compared with the above-mentioned first embodiment, because there are differences in shapes of the arch core 653P and a thermal contraction cap 80P, the differences will be described, but description of common points is omitted. In FIGS. 7A and 7B, each component having similar structure and function to the component of the above-mentioned first embodiment is indicated by reference numeral applied P to the end of reference numeral of corresponding component according to the first embodiment.

The arch core 653P includes a first core end part 653AP (one end part), a second core end part 653BP (another end part), an engaging part 653CP. The first core end part 653AP is one end part of the arch core 653P formed in an arch shape and the second core end part 653BP is another end part of the arch core 653P. The first core end part 653AP is arranged at the upstream side in the rotating direction of the fixing belt 64 in the arch core 653P and the second core end part 653BP is arranged at the downstream side in the rotating direction of the fixing belt 64 in the arch core 653P.

The engaging part 653CP is a projected piece formed in a distal end part of the first core end part 653AP. The engaging part 653CP is formed in a shape projected from a distal end of the first core end part 653AP toward the direction intersecting the rotating direction of the fixing belt 64. The arch core holding part 70P includes an installation face 70SP, an engaged part 70GP and a holding piece 70HP (a projected piece). The installation face 70SP is a face facing to the arch core 653P and is formed in an arch shape similar to the arch core 653P.

The thermal contraction cap 80P (a securing member) includes the cap lateral part 801P (a part having a first ring shape) and a cap facing part 802P (a sealing face). The cap lateral part 801P has a shape bundling integrally the second core end part 653B P of the arch core 653P and the holding piece 70HP. In other words, the cap lateral part 801P is composed of four lateral faces forming a rectangular shape by connecting to each other in the thermal contraction cap 80P formed in a roughly rectangular-parallelepiped shape. The cap facing part 802P is a sealing face connected to the cap lateral part 801P composed of four lateral faces in the thermal contraction cap 80P. The cap facing part 802P is arranged so as to face to the second core end part 653BP of the arch core 653P and the distal end part of the holding piece 70HP.

In the second embodiment, the engaging part 653C of the arch core 653P is engaged with the engaged part 70GP of the arch core holding part 70P. In addition, the second core end part 653BP of the arch core 653P and the holding piece 70HP of the arch core holding part 70P are secured in a body by the thermal contraction cap 80P. In the second embodiment, corresponding structure to the gap part 653D and the opening part 80G of the above-mentioned first embodiment are not provided. Even in such a configuration, by heating initially the thermal contraction cap 80P, it is possible to stably secure the arch core 653P to the arch core holding part 70P.

Figure 8A:
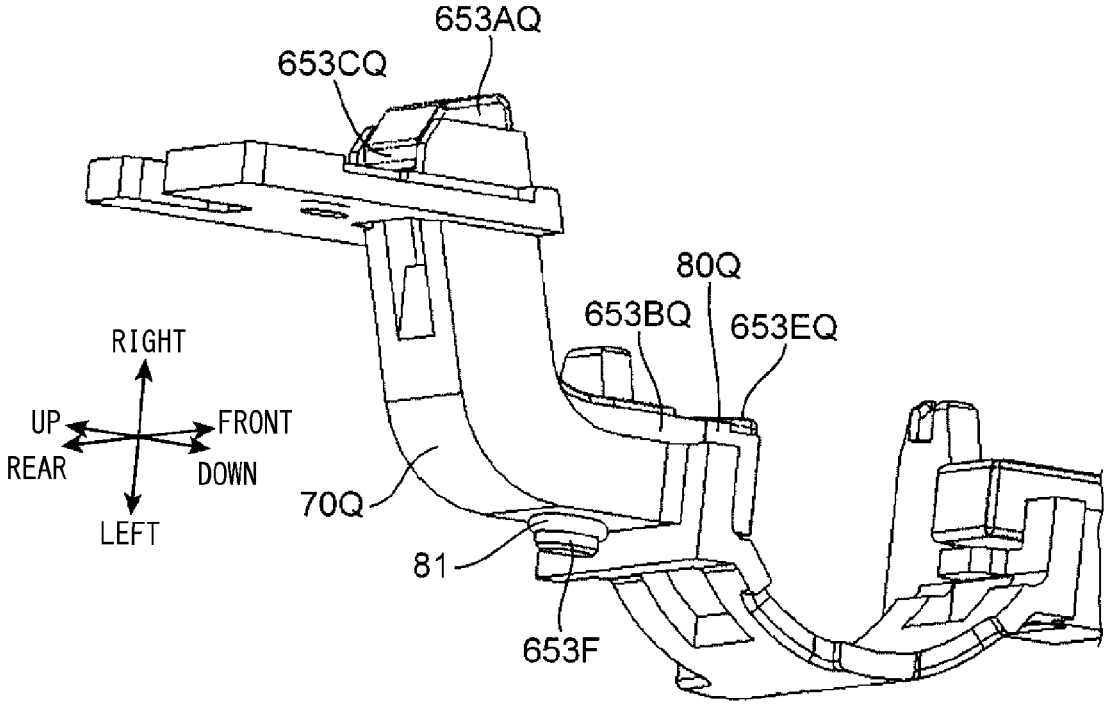
FIG. 8A is a perspective view showing the core member, the housing and the securing member in a condition where the core member is secured to the housing
Figure 8B:
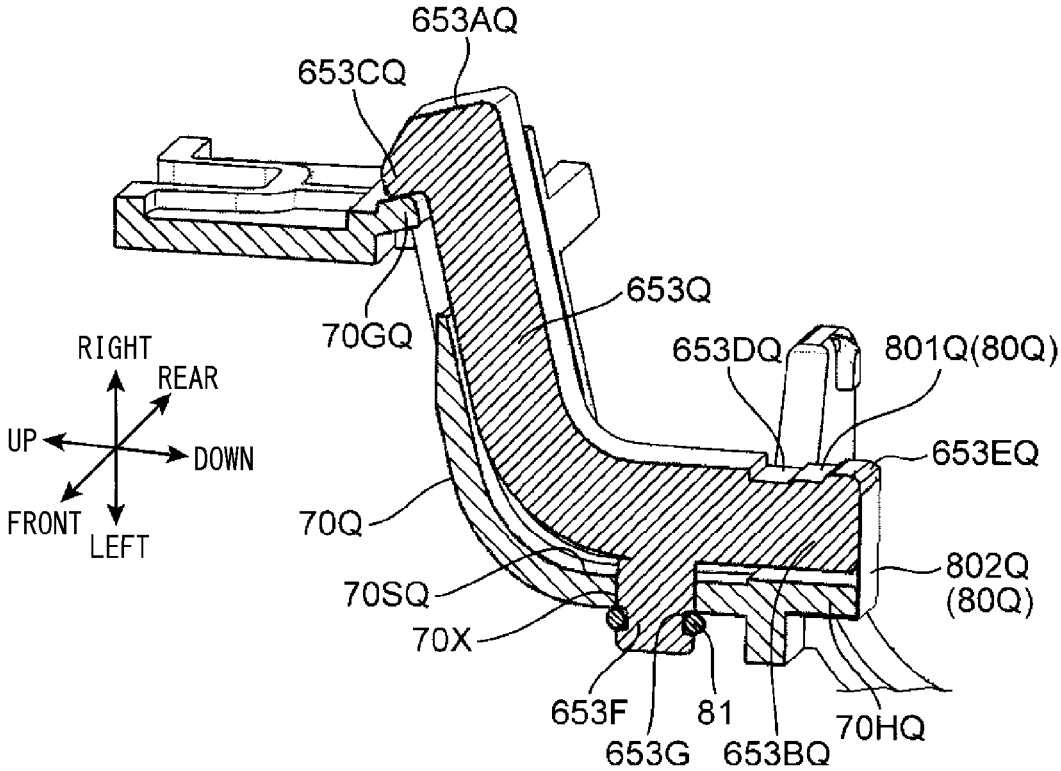
FIG. 8B is a sectional perspective view showing the core member, the housing and the securing member in a condition where the core member is secured to the housing, in accordance with a third embodiment of the present disclosure.

Next, a securing structure of an arch core 653Q (a core member) according to a third embodiment of the present disclosure will be described. FIGS. 8A and 8B are a perspective view and a sectional perspective view showing a situation where the arch core 653Q according to the third embodiment is secured to an arch core holding part 70Q (a part of the housing). In the third embodiment, as compared with the above-mentioned first embodiment, because there are differences in shapes of the arch core 653Q and a thermal contraction cap 80Q, the differences will be described, but description of common points is omitted. In FIGS. 8A and 8B, each component having similar structure and function to the component of the above-mentioned first embodiment is indicated by reference numeral applied Q to the end of reference numeral of corresponding component according to the first embodiment.

In the third embodiment, an engaging part 653CQ of the arch core 653Q is engaged with an engaged part 70GQ of the arch core holding part 70Q. In addition, the second core end part 653BQ (another end part) of the arch core 653Q and a holding piece 70HQ (a projected piece) of the arch core holding part 70Q are secured in a body by the thermal contraction cap 80Q (a securing member). In this time, a cap lateral part 801Q of the thermal contraction cap 80Q bundles integrally the second core end part 653BQ of the arch core 653Q and the holding piece 70HQ. A part of the cap lateral part 801Q is engaged with a gap part 653DQ of the arch core 653Q. A cap facing part 802Q as a sealing face is connected to the cap lateral part 801Q composed of four lateral faces. The cap facing part 802Q is arranged so as to face to the second core end part 653BQ of the arch core 653Q and the distal end part of the holding piece 70HQ. Further, the arch core 653Q includes an engaging protrusion 653F (a protrusion part) and a ring gap 653G (a second gap part). In addition to the thermal contraction cap 80Q, a thermal contraction ring 81 (a securing member) secures the arch core 653Q to the arch core holding part 70Q.

The arch core 653Q includes a first core end part 653AQ (one end part) arranged at the upstream side in the rotating direction of the fixing belt 64 (refer to FIG. 2) and a second core end part 653BQ (another end part) arranged at the downstream side in the rotating direction. The engaging protrusion 653F is a protrusion part protruded between the first core end part 653AQ and the second core end part 653BQ toward the direction (a left direction) intersecting the rotating direction of the fixing belt 64. In the third embodiment, the engaging protrusion 653F is formed in a columnar shape. The ring gap 653G is a gap part formed in a ring shape at a distal end of the engaging protrusion 653F. Into the ring gap 653G, the thermal contraction ring 81 is fitted.

The arch core holding part 70Q includes a hole part 70X. The hole part 70X is an opening part opened in a circular shape so as to penetrate through the arch core holding part 70Q from an installation face 70SQ. Into the hole part 70X, the engaging protrusion 653F of the arch core 653Q is inserted.

The thermal contraction ring 81 is a member in a ring shape (a second ring shape) fitted onto the engaging protrusion 653F and is made of thermal contraction material similar to the thermal contraction cap 80Q. Incidentally, the thermal contraction ring 81 has an external diameter larger than an internal diameter of the hole part 70X.

As shown in FIGS. 8A and 8B, when the arch core 653Q is installed to the arch core holding part 70Q, the engaging protrusion 653F is inserted into the hole part 70X. Moreover, to the ring gap 653G of the engaging protrusion 653F exposed to the outside of the arch core holding part 70Q, thermal contraction ring 81 is installed. Subsequently, when the thermal contraction ring 81 is initially heated together with the thermal contraction cap 80Q by a predetermined heating tool, the thermal contraction ring 81 is contracted and a center part of the arch core 653Q is stably secured to the arch core holding part 70Q. In this time, since the arch core 653Q is positioned to the installation face 70SQ, it is possible to stably maintain a magnetic path made by the arch core 653Q. In addition, since the thermal contraction ring 81 is fitted into the ring gap 653G, it is possible to prevent the thermal contraction ring 81 from being detached from the engaging protrusion 653F. Further, since the thermal contraction ring 81 secures the engaging protrusion 653F of the arch core 653Q protruded from the hole part 70X to the arch core holding part 70Q, it is possible to stably maintain a position of the arch core 653Q.

Incidentally, in another embodiment, it may be configured so that the arch core 653Q is secured to the arch core holding part 70Q by the engaging part 653CQ and the engaged part 70GQ, and the engaging protrusion 653F and the thermal contraction ring 81 without installing the thermal contraction cap 80Q to the arch core 653Q.

In the foregoing, the induction heating unit 65, and a fixing device 60 and the image forming apparatus 1 including this according to the embodiments of the disclosure were described. The disclosure is not limited by these embodiments, for example, can take the following improved embodiment.

Figure 9:
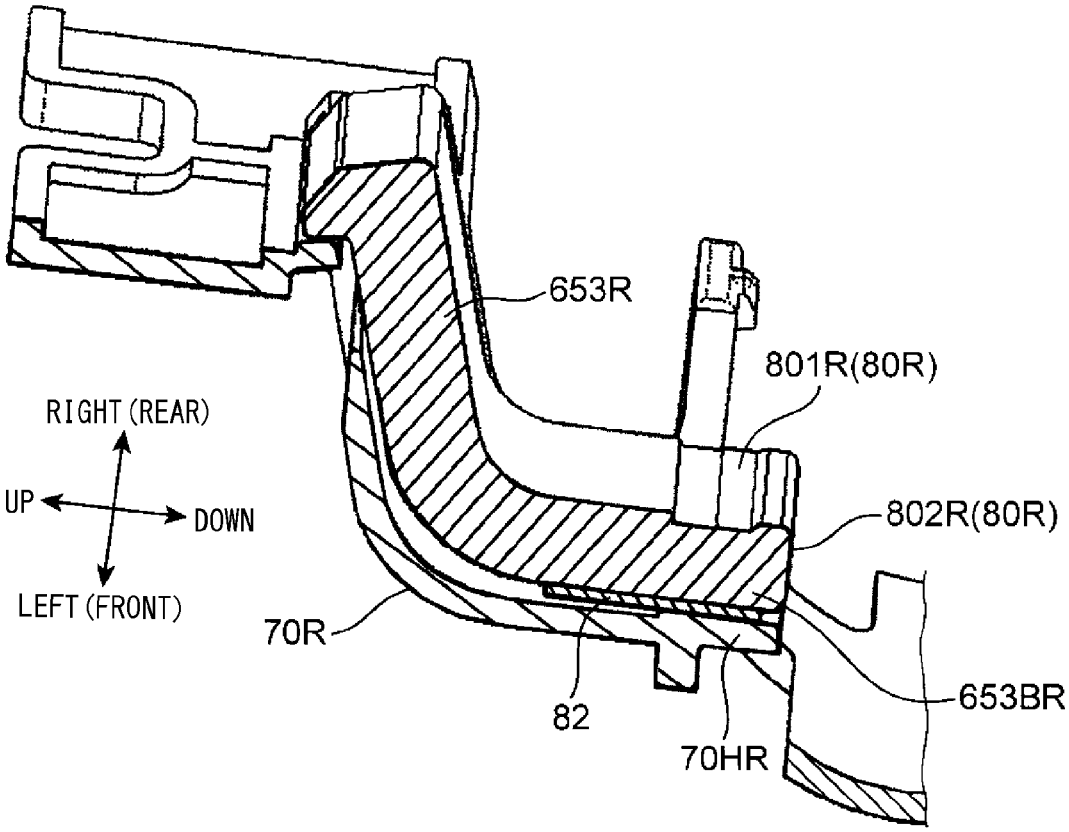
FIG. 9 is a sectional perspective view showing the core member, the housing and the securing member in a condition where the core member is secured to the housing in accordance with an improved embodiment of the present disclosure.

(1) FIG. 9 is a sectional perspective view showing a situation where the arch core 653R (a core member) according to one improved embodiment of the disclosure is secured to an arch core holding part 70R (a part of the housing). In the one improved embodiment, as compared with the above-mentioned first embodiment, because there is a difference in including an elastic sheet 82, the difference will be described, but description of common points is omitted. In FIG. 9, each component having similar structure and function to the component of the above-mentioned first embodiment is indicated by reference numeral applied R to the end of reference numeral of corresponding component according to the first embodiment.

In the one improved embodiment, the induction heating unit (not shown) includes the elastic sheet 82 (an elastic member). The elastic sheet 82 is made of a fluorine-based or silicone-based sponge material. The elastic sheet 82 is a plate like member arranged between the arch core 653R and the arch core holding part 70R. The elastic sheet 82 is compressively deformed between the arch core 653R and the arch core holding part 70R by thermal contraction of a thermal contraction cap 80R (a securing member). According to such a configuration, when the arch core 653R makes a magnetic path, even if the arch core 653R is vibrated by magnetic field, it is possible to absorb vibration energy by the elastic sheet 82. As a result, it is possible to prevent the thermal contraction cap 80R from being detached from the arch core 653R due to vibration. Moreover, it is possible to prevent occurrence of strange noise due to vibration.

(2) Although, in the above-mentioned first embodiment, the fixing unit 60U including the heating roller 61 and the fixing belt 64 is illustrated, in another improved embodiment, another fixing unit without these may be applied. Concretely, it may be configured so that, around an external circumference of the fixing roller 62, a cylindrical belt made of magnetic body similar to the fixing belt 64. In the other improved embodiment, the induction heating unit 65 inductively heats the cylindrical belt.

(3) Although, in the above-mentioned first embodiment, the situation where the arch core 653 as the core member is secured by the thermal contraction cap 80 was described, the disclosure is not restricted by this. In a further improved embodiment, another situation where another core member, such as the side core 654, is secured to the unit housing 650 by the securing member made of thermal contraction material can be applied.

(4) Although, in the above-mentioned first embodiment, the situation where the thermal contraction cap 80 is formed in the cap shape was described, the disclosure is not restricted by this. In a furthermore improved embodiment, the thermal contraction cap 80 may be composed of the cap lateral part 801 without the cap facing part 802. The cap lateral part 801 is not restricted by four lateral faces connected in a rectangular shape, but may be formed in a circular ring shape. The ring shape of the disclosure is sufficiently an endless member which can bundle the holding piece 70H and the second core end part 653B (an end part of the arch core 653) and is not restricted by a shape before initially heating.

(5) Although, in the above-mentioned first embodiment, the situation where, in the arch core 653, a side of the first core end part 653A is engaged with the engaged part 70G and a side of the second core end part 653B is secured by the thermal contraction cap 80 was described, the disclosure is not restricted by this. In another different improved embodiment, both the first core end part 653A and the second core end part 653B may be secured by the thermal contraction cap 80.

In the disclosure, the induction heating unit 65 in an electromagnetic induction heating manner, and a fixing device 60 and the image forming apparatus 1 including this can accurately determine the position of the arch core 653 (the core member) in the induction heating unit 65. As a result, in the fixing device 60, in a condition where the fixing belt 64 (the heating member) is stably heated, the fixing process is performed to the sheet. Moreover, in the image forming apparatus 1, the fixing process is stably performed to the sheet with the transferred toner image.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. An induction heating unit configured to inductively heat a heating member being rotated in a predetermined rotating direction by magnetic flux, comprising:

a housing;

a magnetic flux generating source fixed to the housing so as to extend in a sheet width direction intersecting the rotating direction and configured to generate the magnetic flux;

a core member made of magnetic material, secured to the housing and configured so as to make a magnetic path through which the magnetic flux passes; and a securing member made of thermal contraction material and contracted by being heated at predetermined temperature to secure the core member to the housing, wherein the core member is an arch core extending in an arch shape along the rotating direction, the arch core including one end part arranged at an upstream side in the rotating direction and another end part arranged at a downstream side in the rotating direction, the housing includes a projected piece projected along the one end part or the other end part of the arch core, the securing member has at least a first ring shape bundling integrally the one end part or the other end part of the arch core with the projected piece.

2. The induction heating unit according to claim 1, wherein the securing member is formed in a cap shape being connected in the first ring shape and further including a sealing face facing to a distal end part of the one end part or a distal end part of the other end part of the arch core and a distal end part of the projected piece.

3. The induction heating unit according to claim 1, wherein the arch core further includes a first gap part into which a part of the first ring shape of the securing member.

4. The induction heating unit according to claim 3, wherein the securing member further includes an opening part into which a part of the arch core at a distal end side from the first gap part is inserted.

5. The induction heating unit according to claim 1, wherein the securing member is installed to one of the one end part and the other end part of the arch core, the arch core includes an engaging part protruded from another of the one end part and the other end part of the arch core toward a direction intersecting the rotating direction, the housing includes an engaged part with which the engaging part is engaged.

6. A fixing device comprising:

the induction heating unit according to claim 1; and the heating member being rotated in a predetermined rotating direction, inductively heated by the magnetic flux and configured so as to perform fixing process to a sheet.

7. An image forming apparatus comprising:

an image carrier having a surface onto which a toner image is formed;

a transferring part transferring the toner image onto the sheet; and the fixing device according to claim 6.

8. The induction heating unit according to claim 1 further comprising:

an elastic member arranged between the core member and the housing and compressively deformed according to contraction of the securing member.

9. An induction heating unit configured to inductively heat a heating member being rotated in a predetermined rotating direction by magnetic flux, comprising:

a housing;

a magnetic flux generating source fixed to the housing so as to extend in a sheet width direction intersecting the rotating direction and configured to generate the magnetic flux;

a core member made of magnetic material, secured to the housing and configured so as to make a magnetic path through which the magnetic flux passes; and a securing member made of thermal contraction material and contracted by being heated at predetermined temperature to secure the core member to the housing, wherein the core member is an arch core extending in an arch shape along the rotating direction, the arch core including one end part arranged at an upstream side in the rotating direction, another end part arranged at a downstream side in the rotating direction and a protrusion part between the one end part and the other end part toward a direction intersecting the rotating direction, the housing includes a hole part into which the protrusion part is inserted, the securing member has an external diameter larger than an internal diameter of the hole part and is formed in a second ring shape fitted onto a distal end part of the protrusion part penetrating through the hole part.

10. The induction heating unit according to claim 9, wherein the distal end part of the protrusion part has a second gap part into which the securing member is fitted.

11. The induction heating unit according to claim 9 further comprising:

an elastic member arranged between the core member and the housing and compressively deformed according to contraction of the securing member.

12. A fixing device comprising:

the induction heating unit according to claim 9; and the heating member being rotated in a predetermined rotating direction, inductively heated by the magnetic flux and configured so as to perform fixing process to a sheet.

13. An image forming apparatus comprising:

an image carrier having a surface onto which a toner image is formed;

a transferring part transferring the toner image onto the sheet; and the fixing device according to claim 12.

* * * * *